US006001020A

United States Patent [19]

Nagelski et al.

[11] Patent Number: 6,001,020

[45] Date of Patent: Dec. 14, 1999

[54] TODDLER CLIMB AND SLIDE

[75] Inventors: Keith C. Nagelski, Huntersville; Ian W. Cunningham, Charlotte; Robin E. Smith, Mooresville, all of N.C.

[73] Assignee: Soft Play, L.L.C., Charolotte, N.C.

[21] Appl. No.: 09/206,524

[22] Filed: Dec. 7, 1998

[51] Int. Cl.[6] ..... A63G 21/04

[52] U.S. Cl. ..... 472/116; 482/35

[58] Field of Search ..... 472/116, 117, 472/136; 482/34, 35, 36; D21/814, 818, 822

[56] References Cited

U.S. PATENT DOCUMENTS

| | | | |
|---|---|---|---|
| D. 355,693 | 2/1995 | Aker et al. | D21/814 |
| 4,865,312 | 9/1989 | Katz | 472/116 |
| 5,816,980 | 10/1998 | Myszka et al. | 482/35 |
| 5,842,926 | 12/1998 | Rodriguez-Ferre | 472/116 |

*Primary Examiner*—Kien T. Nguyen
*Attorney, Agent, or Firm*—Polster, Lieder Woodruff & Lucchesi, L.C.

[57] ABSTRACT

A modular/convertible toddler climb unit is disclosed. This unit can be used independently in a variety of different ways as well as combined with other units to form a dynamic and physical skill development structure for children. The unit includes a base with adjacent steps and a slide formed on an upper sloping surface. Upper fixed side fences are provided on opposite sides of the adjacent steps and slide with upstanding mountable side fences cooperating with at least one of the upstanding fixed side fences in order to serve as boundary around at least part of an upper generally horizontally directed upper surface of the base. The mountable side fences can be positioned on the base in a number of different ways as well as the generally horizontally directed upper surface of two adjacent bases for cooperative interaction between such adjacent bases. Other play units can be associated with the toddler climb and slide unit to provide various play experiences for children.

10 Claims, 3 Drawing Sheets

TODDLER CLIMB AND SLIDE

CROSS-REFERENCE TO RELATED APPLICATIONS

STATEMENT REGARDING FEDERALLY SPONSORED RESEARCH OR DEVELOPMENT

Not Applicable.

BACKGROUND OF THE INVENTION

The present invention relates to a modular/convertible toddler climb and slide unit that can be used independently in a variety of different ways as well as combined with other units to form a dynamic and physical skill development structure.

Existing toddler climb and play systems are complex in design and are made from a number of different parts. This results in significant product and labor costs during manufacture as well as substantial labor costs during assembly of such systems. Further, such existing play systems are single use play systems, and thus not readily capable of being used and/or combined with a variety of different play structures for different play experiences.

As compared to existing prior art toddler climb and play systems, the present invention provides a modular/convertible toddler climb and slide unit that can be used independently in a variety of different ways to provide different play structures. In addition, the modular/convertible toddler climb and slide unit can be combined with other play units to form other play structures. As a result, the modular/convertible construction provides a unique design which overcomes the aforenoted problems of prior art designs while achieving a variety of different play structures.

BRIEF SUMMARY OF THE INVENTION

Among the several objects and advantages of the present invention include:

- the provision of a new and improved modular/convertible toddler climb and slide unit;
- the provision of the aforementioned unit which can be used independently in a number of different ways to provide various play structures;
- the provision of the aforementioned new and improved unit which can also be combined with other play units to form new and different play structures through the unique combination of components; and
- the provision of the aforementioned new and improved unit which is durable, free-standing, readily modifiable, has a high consumer value, and is otherwise well adapted for the purposes intended.

Briefly stated, the toddler climb and slide of the present invention includes a base have an upper generally horizontally directed surface adjacent to an upper sloping surface that extends between the upper generally horizontally directed surface in a floor surface on which the base rests. Adjacent steps and a slide are formed on the upper sloping surface. Upstanding fixed side fences are provided on opposite sides of the adjacent steps and slide. Also, upstanding mountable side fences are provided on the generally horizontally directed upper surface and cooperate with at least one of the upstanding fixed side fences to provide a boundary at least around part of the generally horizontally directed upper surface.

The toddler climb and side unit may include generally opposed upstanding mountable side fences with each one being generally aligned with one of the upstanding fixed side fences.

The toddler climb and slide unit may also have one of the upstanding mountable side fences aligned with one of the fixed side fences with at least one other upstanding mountable side fence extending transverse to one upstanding fixed side fence. In the construction just described, it may also include an additional upstanding mountable side fence that extends between the generally opposed upstanding mountable side fences in the area of the generally vertically directed rear surface of the base. In this way, the upstandable mountable side fence is provided with a boundary around three adjacent marginal areas of the upper generally horizontally directed upper surface.

The toddler climb and slide unit may be associated with an adjacent play unit that includes a receptacle for containing a plurality of balls.

Alternatively, the adjacent play unit may be positioned in proximity to the generally vertically directed rear surface of the toddler climb and slide with the upstanding mountable side fences in the area of the generally vertically directed rear surface of the base defining an opening which is aligned with an opening of the adjacent play unit.

The adjacent play unit mean have a seat surface in a generally vertically directed rear surface of the base or may have a roof positioned over the adjacent play unit. Alternatively, a roof play unit may be positioned over the upstanding mountable side fences on the generally horizontally directed upper surface.

These and other objects of the present invention will become apparent from the description that follows.

BRIEF DESCRIPTION OF THE SEVERAL VIEWS OF THE DRAWINGS

In the drawings.

Corresponding reference numerals will be used throughout the several figures of the drawings.

DETAILED DESCRIPTION OF THE INVENTION

Figure 1:
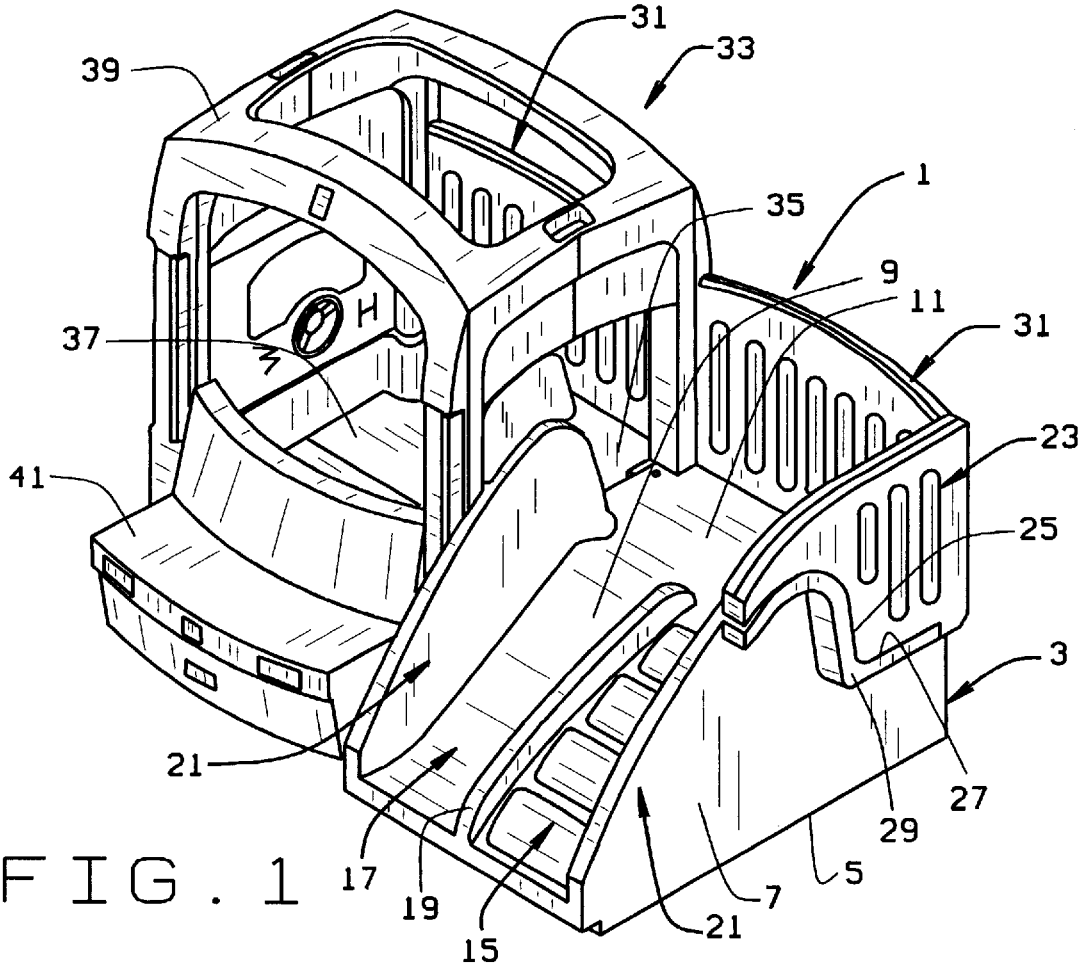
FIG. 1 is a front perspective view of one preferred embodiment of the toddler climb and slide unit of the present invention.

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention.

While there are several preferred embodiments shown in FIGS. 1–2, FIG. 3, FIG. 4, FIG. 5 and FIG. 6 of the drawings, it will be appreciated that each of the preferred embodiments shown in the drawings have common components, as will be discussed below. As a result, the common components of the toddler climb slide provides a variety of useful unit configurations which use the same common components. This not only facilitates ease of assembly, but reduces installation costs through consumer friendly engineered components that affords a variety of different dynamic play and physical skill development structures. The common components in the various illustrative embodiments will become apparent from the discussion that follows.

Figure 2:
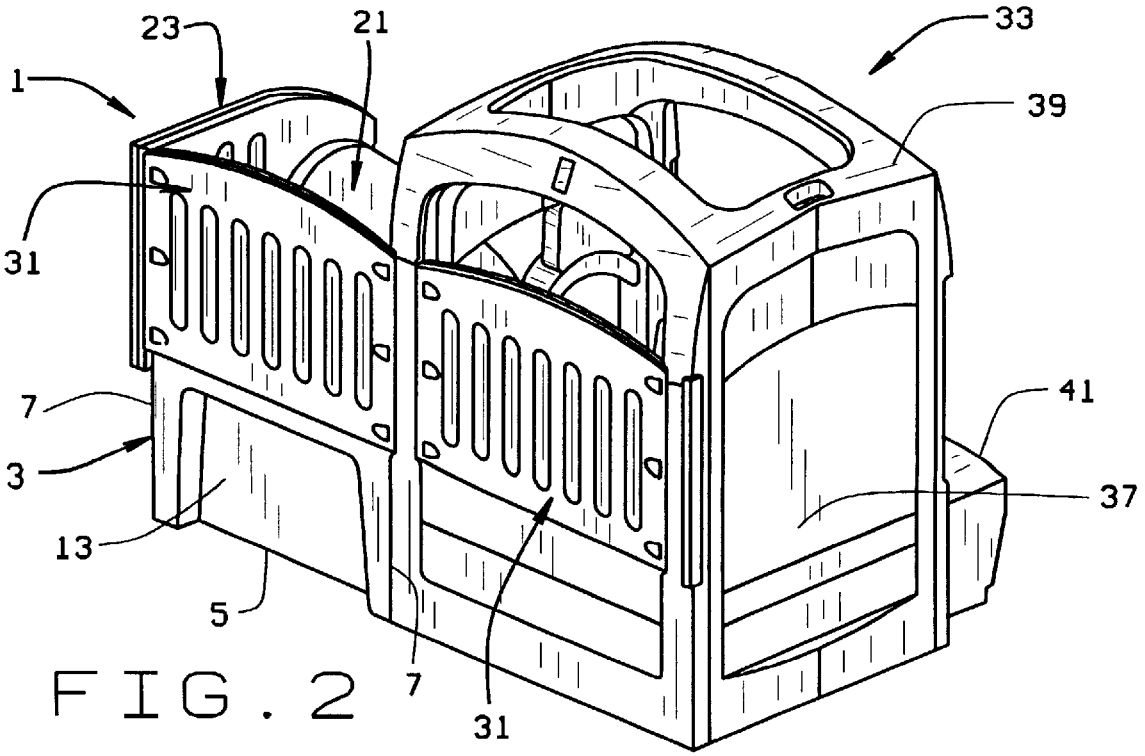
FIG. 2 is a rear perspective view of the toddler climb and slide unit shown in FIG. 1.

Referring first to the toddler climb and slide unit 1 shown in FIGS. 1–2 of the drawings, it will be seen that the toddler climb and slide unit includes a base 3 having a bottom surface 5, opposing side surfaces 7, 7 that extend upwardly from the bottom surface 5, an upper sloping surface 9 extending upwardly from the bottom surface 5 and connected to a generally horizontally directed surface 11, and a generally vertically directed rear surface 13 extending between the bottom surface 5 and the upper generally horizontally directed surface 11. Both the upper sloping surface 9 and the upper generally horizontally directed surface 11 extend between the opposing side surfaces 7, 7 of the base 3.

Adjacent steps 15 and a slide 17 are formed on the upper sloping surface 9 and are separated by an upstanding shoulder or runner 19. It will be also noted that upstanding fixed side fences 21, 21 are provided on the upper sloping surface 9 and extend on opposite sides of the adjacent steps 15 and slide 17. The upstanding fixed side fences 21, 21 are an integral extension of the generally opposing side surfaces 7, 7 of the base 3. As will be appreciated, the upstanding fixed side fences 21, 21 serve as a guide and safety feature for children using the steps 15 and slide 17.

In addition to the aforementioned common components in various illustrated embodiments of the invention, there is also at least one upstanding mountable side fence 23 that cooperates with at least one of the upstanding fixed side fences 21 to provide a boundary around at least part of the generally horizontally directed upper surface 11. In the FIGS. 1–2 embodiment, there is one such upstanding mountable side fence 23 which is removably positioned and fastened relative to the base 3 to provide the illustrated design. Each of the mountable fences are removably mounted as compared to the fixed fences, as will be appreciated. It will also be noted that the lower curvilinear edge 25 of the upstanding mountable side fence has a shape that is complementary to an upper curvilinear edge 27 of an integral curvilinear extension 29 that extends along the outside face of a side surface 7 between an upstanding fixed side fence 21 and the generally vertically directed rear surface 13 of the base 3.

As best seen in FIG. 1 of the drawings, the lower curvilinear edge surface 25 has complementary interfitting engagement with the upper curvilinear edge surface 27 for supporting the upstanding mountable side fence 23. The position illustrated shows that it is in general alignment with its associated upstanding fixed side fence 21 so as to provide a boundary along at least one side of the upper generally horizontally directed surface 11.

In the FIGS. 1–2 embodiment, a second upstanding mountable side fence 31 is mounted to the base 3 and a rear edge of the upper horizontally directed surface 11 that is generally aligned with the rear surface 11 of the base. Thus, a child can climb up the steps 15, walk across the upper horizontally directed surface 11 until generally in alignment with the slide 17 and then slide down the slide 17. Alternatively, the child can climb the steps 15 and stand on the upper horizontally directed surface 11 protected by the side and rear upstanding mountable side fences 23, 31 respectively.

Additionally, the toddler climb and slide unit 1 shown in FIGS. 1 and 2 of the drawings is associated with an adjacent play unit 33 that is accessible through an opening 35 between the rear upstanding mountable side fence 31 and the upstanding fixed side fence 21 adjacent the play unit 33. The adjacent play unit 33 itself is the type which includes a receptacle 37 for receiving a plurality of balls (not shown) to form what is known as a "ball pit" that is well liked by children. The adjacent play unit 33 also includes an overlying roof 39 that extends above the receptacle 37 as well as a seat surface 41 along the front of the adjacent play unit 33. As will be appreciated, the adjacent play unit 33 is one of a number of different types of adjacent play units that can be used with the toddler climb and slide unit 1, as will be appreciated. As best seen in FIG. 2, a rear upstanding mountable side fence 31 also serves as a protective guide or barrier in the adjacent play unit 33 in similar manner as the clear upstanding mountable side fence 31 and the toddler climb and slide unit 1.

Figure 3:
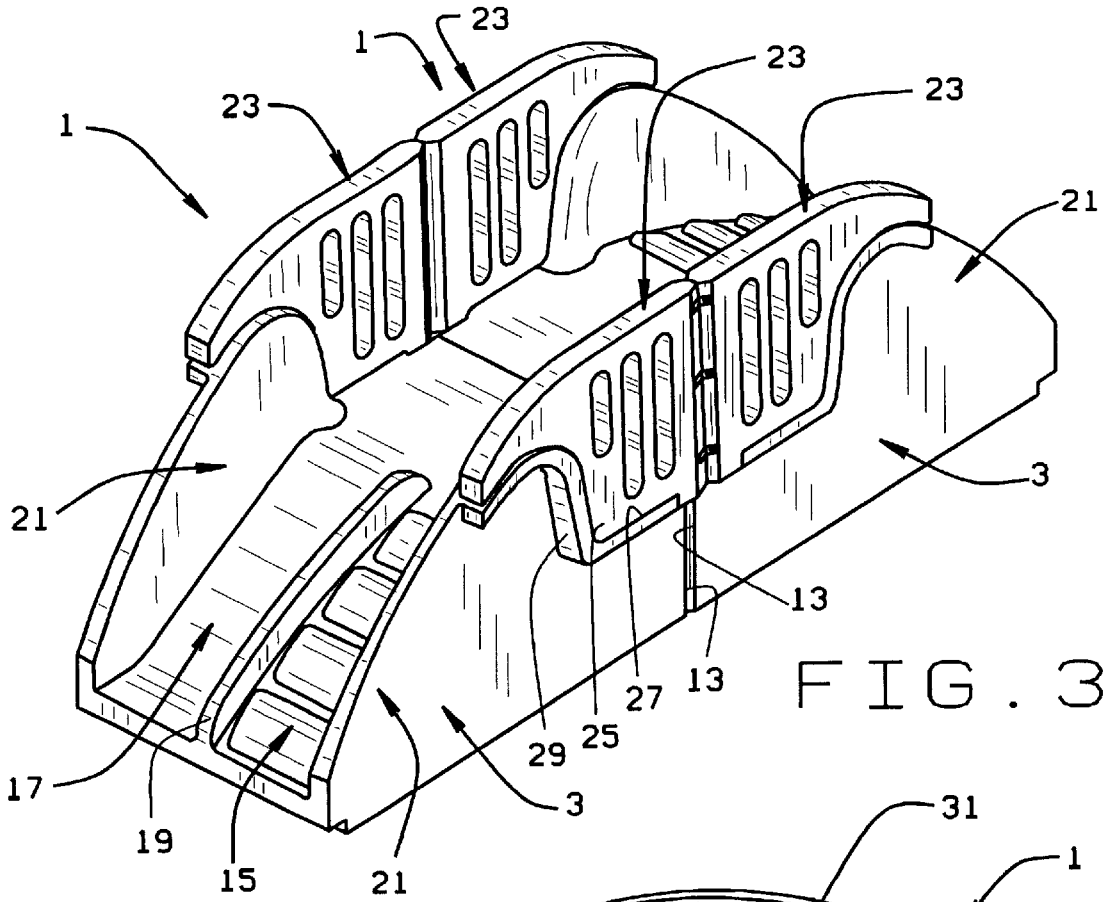
FIG. 3 is a front perspective view of another preferred embodiment of the toddler climb and slide unit of the present invention.

Reference is now made to another embodiment shown in FIG. 3 of the drawings where two bases 3,3 are positioned adjacent one another with the generally vertically directed rear surfaces 13 of each base 3 in proximity to one another. This enables upstanding mountable side fences 23, 23 to be mounted in opposition to one another with the lower curvilinear edge 25 of each upstanding mountable side fence 23 complementary to an upper curvilinear edge 27 of each integral curvilinear extension 29. As illustrated in FIG. 3, this arrangement enables upstanding mountable side fences 23 on the adjacent bases 3 to be generally aligned with each other on opposite sides of the bases 3, as illustrated. This enables a child to climb either of the steps 15 on one of the bases 3 and either slide down the slide 17 or adjacent associated steps 15 or travel across the upper horizontally directed surfaces 11 of each base 3 in order to climb down or slide down the steps 15 or associated slide 17 on the other base 3. Converting a toddler climb and slide of the present invention into the embodiment shown in FIG. 3 of the drawings can be quickly and easily accomplished using the common components of the present invention.

Figure 4:
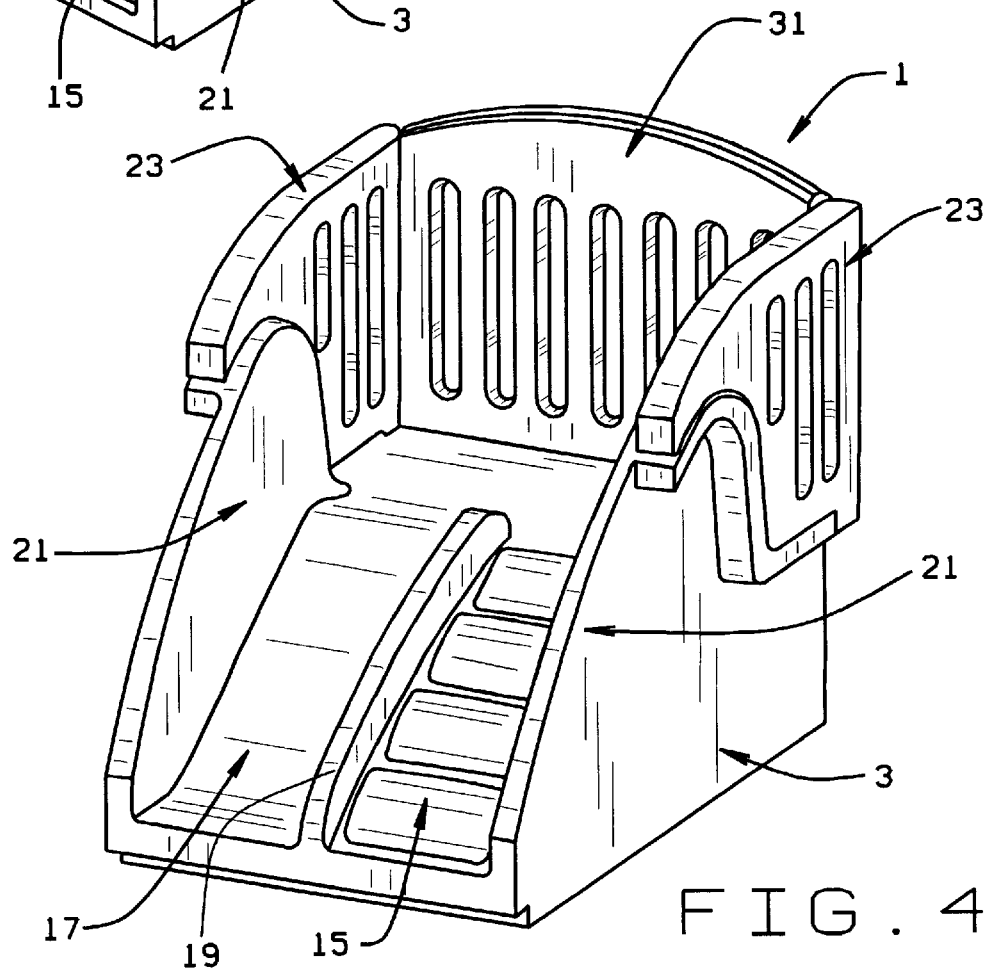
FIG. 4 is a further preferred embodiment of the toddler climb and slide unit of the present invention.

In FIG. 4 of the drawings, only a single base unit 3 is shown with opposed upstanding mountable side fences 23, 23 and a rear upstanding mountable side fence 31 extending between such side fence as 23, 23, as illustrated. Thus, the side and rear upstanding mountable side fences 23, 23 and 31 provide a boundary and safety barrier for use by children when using the toddler climb and slide unit shown in FIG. 4 of the drawings.

Figure 5:
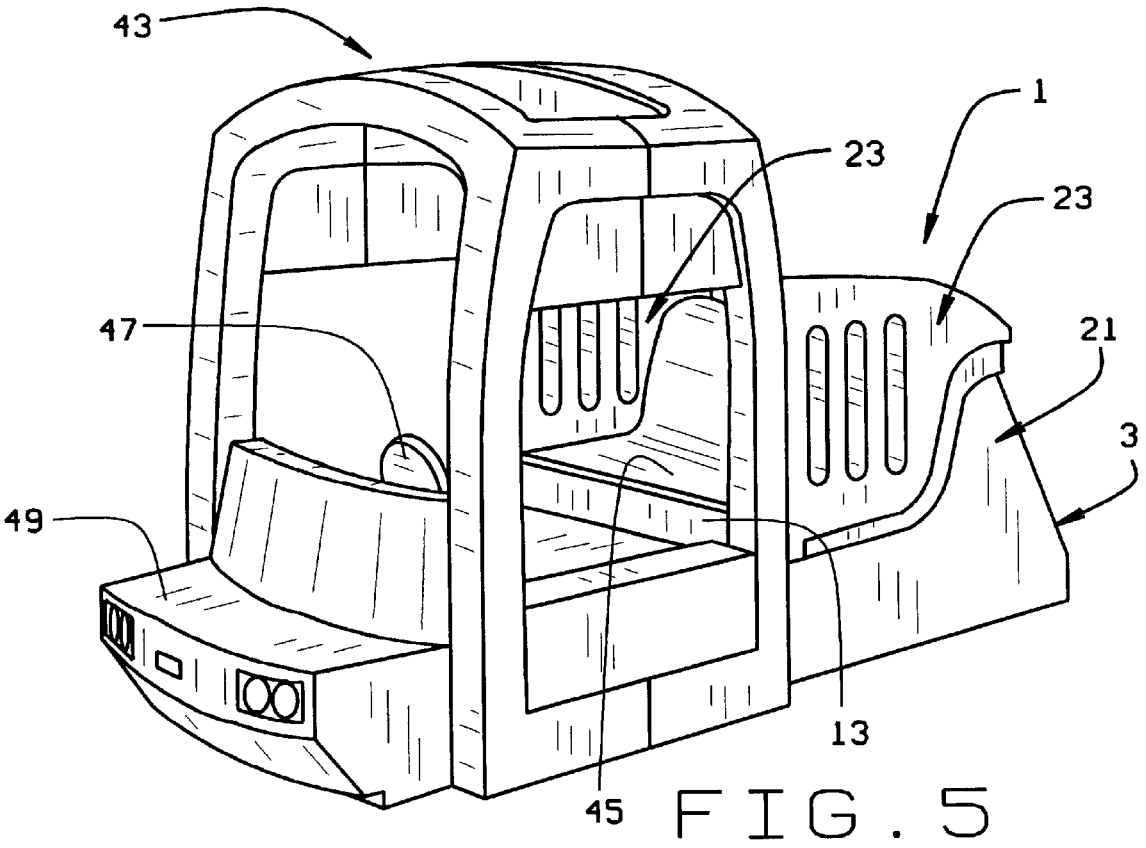
FIG. 5 is still another preferred embodiment of the toddler climb and slide unit of the present invention.

The embodiment shown in FIG. 5 shows a toddler climb and slide unit also associated with an adjacent play unit 43; however, in this instance, the adjacent play unit 43 is positioned along the rear surface 13 of the base 3. The base 3 itself includes an upstanding mountable side fences 23, 23 to define an opening aligned with the adjacent play unit 43 in the area of the generally vertically directed rear surface 11. Further, a seat surface 45 is provided in the area of the generally vertically directed rear surface 11 to enable children to imagine that the adjacent play unit 43 is a vehicle. For this purpose, the adjacent play unit 43 is provided with a play steering wheel 47. Also the adjacent play unit 43 includes a front seat surface 49 to enable children to sit on the front of the adjacent play unit 43, if desired.

Figure 6:
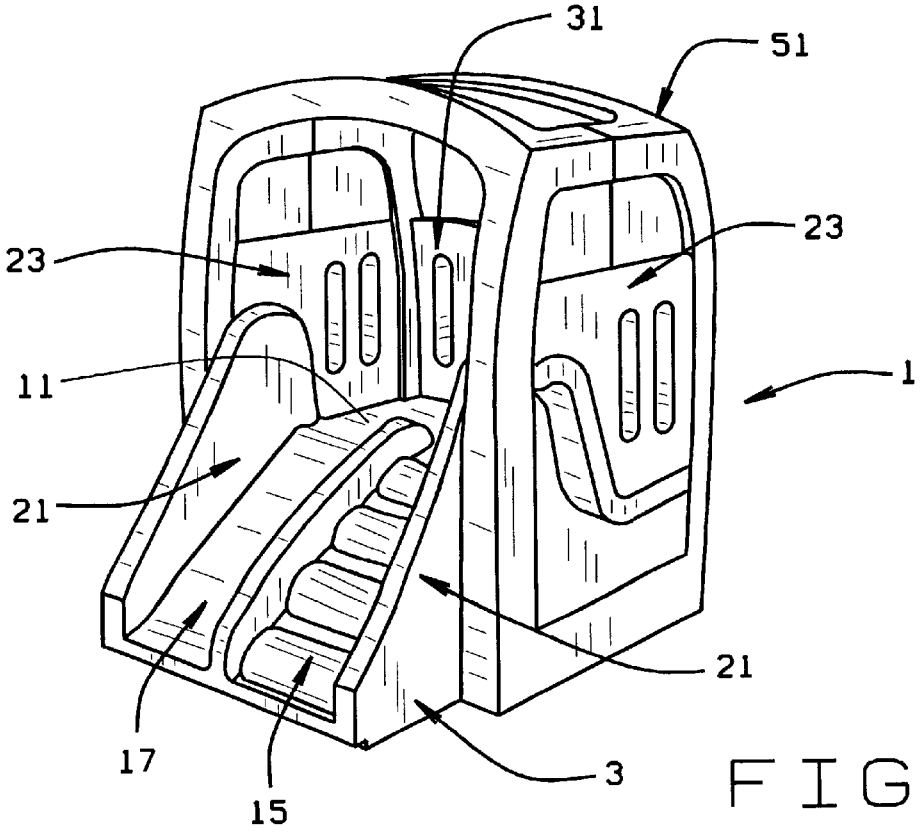
FIG. 6 is yet still a further preferred embodiment of the toddler climb and slide unit of the present invention.

The embodiment shown in FIG. 6 of the drawings is similar to the embodiment shown in FIG. 3 with the exception that a roof unit 51 is positioned over the upper horizontally directed surface 11. As a result, a child can feel like he or she is inside of a "play house" or other similar structure when they climb the steps 15 and stand on the upper horizontally surface 11 until they exit along the slide 17.

From the foregoing, it will not be appreciated that the toddler climb slide unit of the present invention is capable of being modified or/converted into various configurations/embodiments to form a dynamic play and physical skill development structure. The units are durable, readily modifiable, and have a high consumer value, while affording a free standing and independent component design.

In view of the above, it will be seen that the several objects and advantages of the present invention have been achieved and other advantageous results have been obtained.

As various changes could be made in the above constructions without departing from the scope of the invention, it is intended that all matter contained in the above description or shown in the accompanying drawings shall be interpreted as illustrative and not in a limiting sense.

We claim:

1. A toddler climb and slide comprising:

a base including an upper generally horizontally directed surface adjacent to an upper sloping surface that extends between the upper generally horizontally directed surface and a floor surface on which the base rests;

adjacent steps and slide formed on the upper sloping surface;

upstanding fixed side fences on opposite sides of the adjacent steps and slide; and upstanding mountable side fences on the generally horizontally directed upper surface and cooperating with at least one of the upstanding fixed side fences to provide a boundary around at least part of the generally horizontally directed upper surface, one upstanding mountable side fence being aligned with one upstanding fixed side fence, and at least one other upstanding mountable side fence extending transverse to the one upstanding fixed side fence.

2. The toddler climb and slide as defined in claim 1 including generally opposed upstanding mountable side fences with each are being generally aligned with one of the upstanding fixed side fences.

3. The toddler climb and slide as defined in claim 2 including an additional upstanding mountable side fence between the generally opposed upstanding mountable side fences in the area of the generally vertically directed rear surface of the base.

4. A toddler climb and slide, comprising:

a base including a bottom surface, generally opposing side surfaces extending upwards from the bottom surface, an upper sloping surface extending upwardly from the bottom surface and connected to an upper generally horizontally directed surface, both the upper sloping surface and upper generally horizontally directed surface, extending between the generally opposing side surfaces, and a generally vertically directed rear surface extending between the bottom surface and the upper generally horizontally directed surface adjacent steps and a slide formed on the upper sloping surface;

upstanding fixed side fences on the upper sloping surface on opposite sides of the adjacent steps and slide;

upstanding mountable side fences on the upper generally horizontally directed surface and cooperating with at least one of the upstanding fixed side fences and to provide a boundary around at least part of the upper generally horizontally directed upper surface; and first and second identically constructed toddler climb and slide units which are positioned with their generally vertically directed rear surfaces in juxtaposition to one another, and at least one of the upstanding mountable side fences on one unit being aligned with one upstanding mountable side fence on the other unit.

5. The toddler climb and slide as defined in claim 4 including mountable fences in general alignment with upstanding fixed sides fences.

6. A toddler climb and slide, comprising:

a base including a bottom surface, generally opposing side surfaces extending upwards from the bottom surface, an upper sloping surface extending upwardly from the bottom surface and connected to an upper generally horizontally directed surface, both the upper sloping surface and upper generally horizontally directed surface, extending between the generally opposing side surfaces, and a generally vertically directed rear surface extending between the bottom surface and the upper generally horizontally directed surface;

adjacent steps and a slide formed on the upper sloping surface;

upstanding fixed side fences on the upper sloping surface on opposite sides of the adjacent steps and slide;

upstanding mountable side fences on the upper generally horizontally directed surface and cooperating with at least one of the upstanding fixed side fences and to provide a boundary around at least part of the upper generally horizontally directed upper surface;

the upstanding mountable side fences providing a boundary around two adjacent marginal areas of the upper generally horizontally directed surface, a marginal area of the upper generally horizontally directed surface cooperating with an opening in an adjacent play unit.

7. The toddler climb and slide as defined in claim 6 in which the adjacent play unit includes at least one upstanding mountable side fence and an overlying roof.

8. The toddler climb and slide as defined in claim 7 in which the adjacent play unit includes a receptacle for containing a plurality of balls.

9. The toddler climb and slide as defined in claim 6 in which the adjacent play unit is positioned in proximity to the generally vertically directed rear surface of the toddler climb and slide, the upper generally horizontally directed surface in the area of the generally vertically directed rear surface defining an opening which is aligned with an opening of the adjacent play unit.

10. The toddler climb and slide as defined in claim 9 including a seat surface in the area of the generally vertically directed rear surface.

* * * * *